United States Patent [19]

Moriya

[11] Patent Number: 4,537,514

[45] Date of Patent: Aug. 27, 1985

[54] MULTI-FUNCTION ANALOG DISPLAY STOPWATCH

[75] Inventor: Tatsuo Moriya, 3-5, Owa 3-chome, Suwa-shi, Nagano-ken, Japan

[73] Assignee: Kabushiki Kaisha Suwa Seikosha, Tokyo, Japan

[21] Appl. No.: 501,343

[22] Filed: Jun. 6, 1983

[30] Foreign Application Priority Data

| | | | |
|---|---|---|---|
| Jun. 7, 1982 | [JP] | Japan | 57-97292 |
| Jul. 22, 1982 | [JP] | Japan | 57-127908 |
| Dec. 17, 1982 | [JP] | Japan | 57-221574 |

[51] Int. Cl.[3] ..... G04F 8/00

[52] U.S. Cl. ..... 368/107; 368/110; 368/113; 368/102

[58] Field of Search ..... 368/89, 107, 108–113, 368/157, 160

[56] References Cited

U.S. PATENT DOCUMENTS

| | | | |
|---|---|---|---|
| 4,211,066 | 7/1980 | Kusumoto et al. | 368/113 |
| 4,270,197 | 5/1981 | Minowa | 368/102 |

*Primary Examiner*—Bernard Roskoski

*Attorney, Agent, or Firm*—Blum, Kaplan, Friedman, Silberman & Beran

[57] ABSTRACT

An electronic analog timepiece provides for elapsed and intermediate split time measurement with hands indicating fractions of a second, seconds and minutes. Hands do not move except by a user stop or split command. Then the hands rapidly move to positions indicating elapsed or split time. Alternatively, conventional continuous indications are provided except when the internal battery nears depletion, or intermittent operation of the hand indicating fractional seconds provides warning that the battery nears depletion. A wristwatch type analog display stopwatch using a plurality of step motors to drive the hands is produced.

9 Claims, 12 Drawing Figures

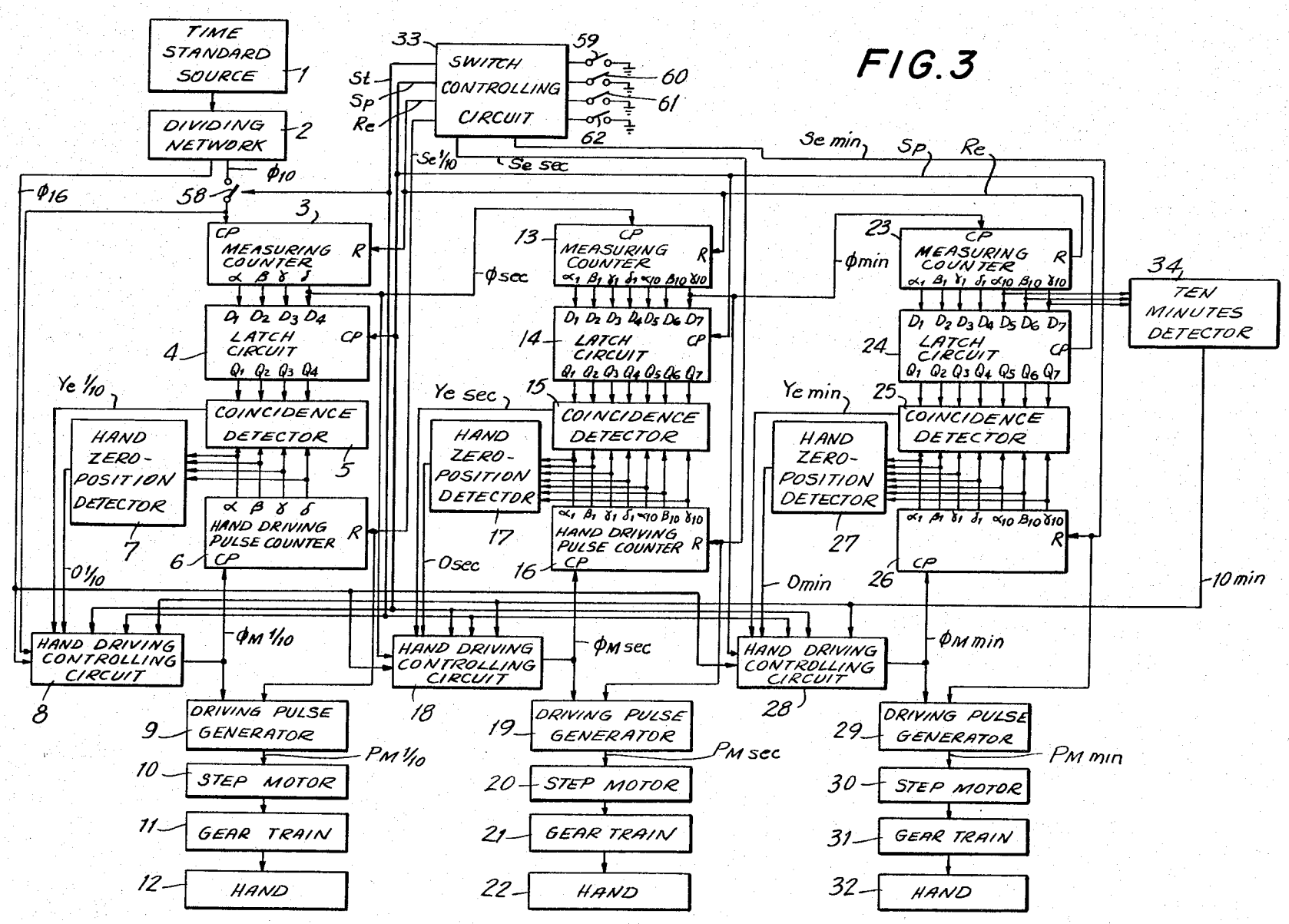
FIG. 3
TIME STANDARD SOURCE
DIVIDING NETWORK
SWITCH CONTROLLING CIRCUIT
MEASURING COUNTER
LATCH CIRCUIT
COINCIDENCE DETECTOR
HAND DRIVING PULSE COUNTER
HAND ZERO-POSITION DETECTOR
HAND DRIVING CONTROLLING CIRCUIT
DRIVING PULSE GENERATOR
STEP MOTOR
GEAR TRAIN
HAND
TEN MINUTES DETECTOR
St
Sp
Re
Se min
Se sec
Se 1/10
Ye min
Ye sec
Ye 1/10
Omin
Osec
O1/10
φ16
φ10
φmin
φsec
φM min
φM sec
φM 1/10
PM min
PM sec
PM 1/10
10 min

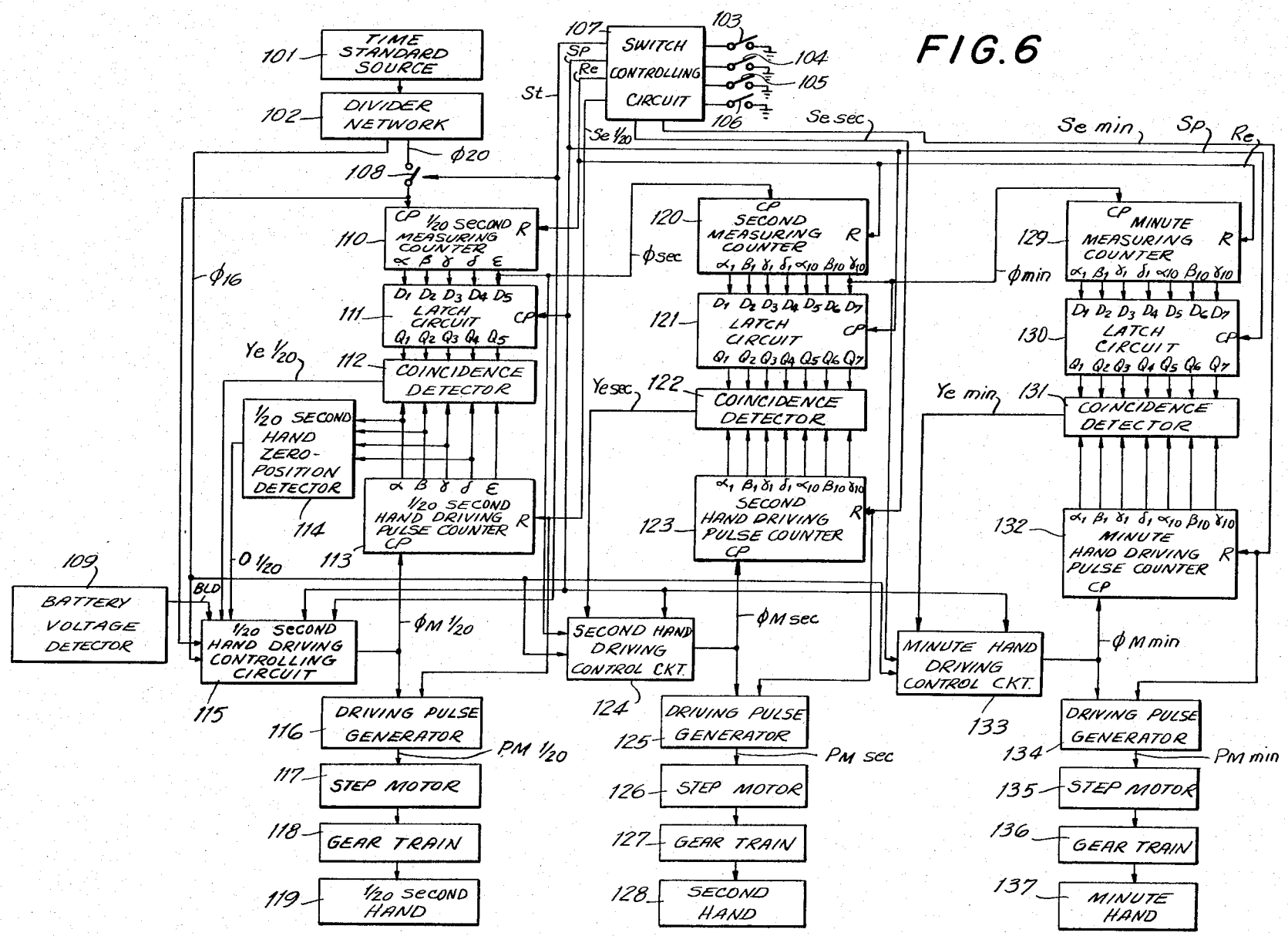
FIG. 6
TIME STANDARD SOURCE
DIVIDER NETWORK
SWITCH CONTROLLING CIRCUIT
MINUTE MEASURING COUNTER
LATCH CIRCUIT
COINCIDENCE DETECTOR
MINUTE HAND DRIVING PULSE COUNTER
MINUTE HAND DRIVING CONTROL CKT.
SECOND MEASURING COUNTER
SECOND HAND DRIVING PULSE COUNTER
SECOND HAND DRIVING CONTROL CKT.
1/20 SECOND MEASURING COUNTER
1/20 SECOND HAND DRIVING PULSE COUNTER
1/20 SECOND HAND ZERO-POSITION DETECTOR
1/20 SECOND HAND DRIVING CONTROLLING CIRCUIT
BATTERY VOLTAGE DETECTOR
DRIVING PULSE GENERATOR
STEP MOTOR
GEAR TRAIN
MINUTE HAND
SECOND HAND
1/20 SECOND HAND

MULTI-FUNCTION ANALOG DISPLAY STOPWATCH

BACKGROUND OF THE INVENTION

This invention relates generally to a stopwatch of the analog type and more particularly, to an analog display stopwatch which consumes little energy. Recently, an analog display stopwatch having a quartz crystal oscillator as a time standard source and a plurality of step motors for driving hands to indicate elapsed time has been developed in place of a conventional entirely mechanical stopwatch. However, as is generally known, a step motor, even if only one step motor is used, requires a high level of electrical power input for driving. Therefore, to drive a plurality of step motors, a battery having a large capacity, that is, a battery of large size, is necessary. Therefore, it has not been possible to provide an analog display stopwatch in such a small size as a wristwatch, or the like. Further, a rapid decline in output voltage of the battery when the battery is near depletion presents a problem in alerting the user of impending battery failure.

What is needed is an analog display stopwatch operating on an electrical battery which has long operating life through low power consumption and provides indication of imminent battery depletion.

SUMMARY OF THE INVENTION

Generally speaking, in accordance with the invention, an analog display stopwatch consuming little energy and providing special voltage indicating features is provided. The timepiece provides for elapsed time measurement and intermediate split time indications. In one embodiment, hands are provided for indicating fractions of a second, seconds and minutes, but these hands do not move except when a stop or split command is inputted by the user. Then the hands rapidly move into the positions indicating the elapsed or split time. In an alternative embodiment, conventional continuous indications are provided except when the battery nears depletion. At that time, the mode of operation described above is initiated. In another embodiment, intermittent operation of the hand indicating fractions of a second provides a warning to the user that the battery nears depletion. Energy conservation methods as described allow for a very small, wristwatch type analog display stopwatch using a plurality of step motors to drive the hands.

Accordingly, it is an object of this invention to provide an improved analog display stopwatch using electrical step motors to drive the hands but having a small size suitable for the wrist.

Another object of this invention is to provide an improved analog display stopwatch which reduces power consumption near the end of battery life so as to prolong the useful period of the timepiece.

A further object of this invention is to provide an improved analog display stopwatch which makes the user aware that depletion of the battery is imminent.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3 is a functional block diagram of an alternative embodiment of an analog display stopwatch in accordance with the invention;

FIG. 6 is a functional block diagram of another alternative embodiment of an analog display stopwatch in accordance with the invention;

DESCRIPTION OF THE PREFERRED EMBODIMENTS

This invention relates to the operation of the hands of an analog display stopwatch which indicates measured, that is, elapsed time by means of hands which are moved by a step motor.

Recently, an analog display stopwatch has been developed having a quartz crystal oscillator as a time standard source and a plurality of step motors for driving hands to indicate elapsed time. This replaces the conventional purely mechanical stopwatch. However, as is generally known, a step motor, even when there is only one step motor, requires high electrical power input for driving. Therefore, in order to drive several step motors, a battery of large capacity, that is, a battery which is physically large, is necessary. As a result it is not possible to provide an analog display stopwatch which is as small as a wristwatch, or the like.

The analog display stopwatch in accordance with the invention eliminates such problems and an object of this invention is to provide an analog display stopwatch of the size of a wristwatch using the following techniques. Namely, measured time is displayed by driving a step motor only when the user wants to know the elapsed time. Thereby, electrical power for driving the step motor is reduced and a small-sized battery is used.

The following is a detailed description of an analog display stopwatch in accordance with the invention.

In a first embodiment, an analog display stopwatch having a 1/10th second hand for display time in 1/10th second units, a second hand for displaying time in seconds, and a minute hand for displaying time in minute units is described. In the analog display stopwatch in accordance with the invention, each hand indicates the zero-position normally but when a signal for commanding a stop in time measurement, or a signal for commanding the display of a split time, that is, a split signal is applied, the measured time is displayed by the hands in response to the above command.

Figure 1:
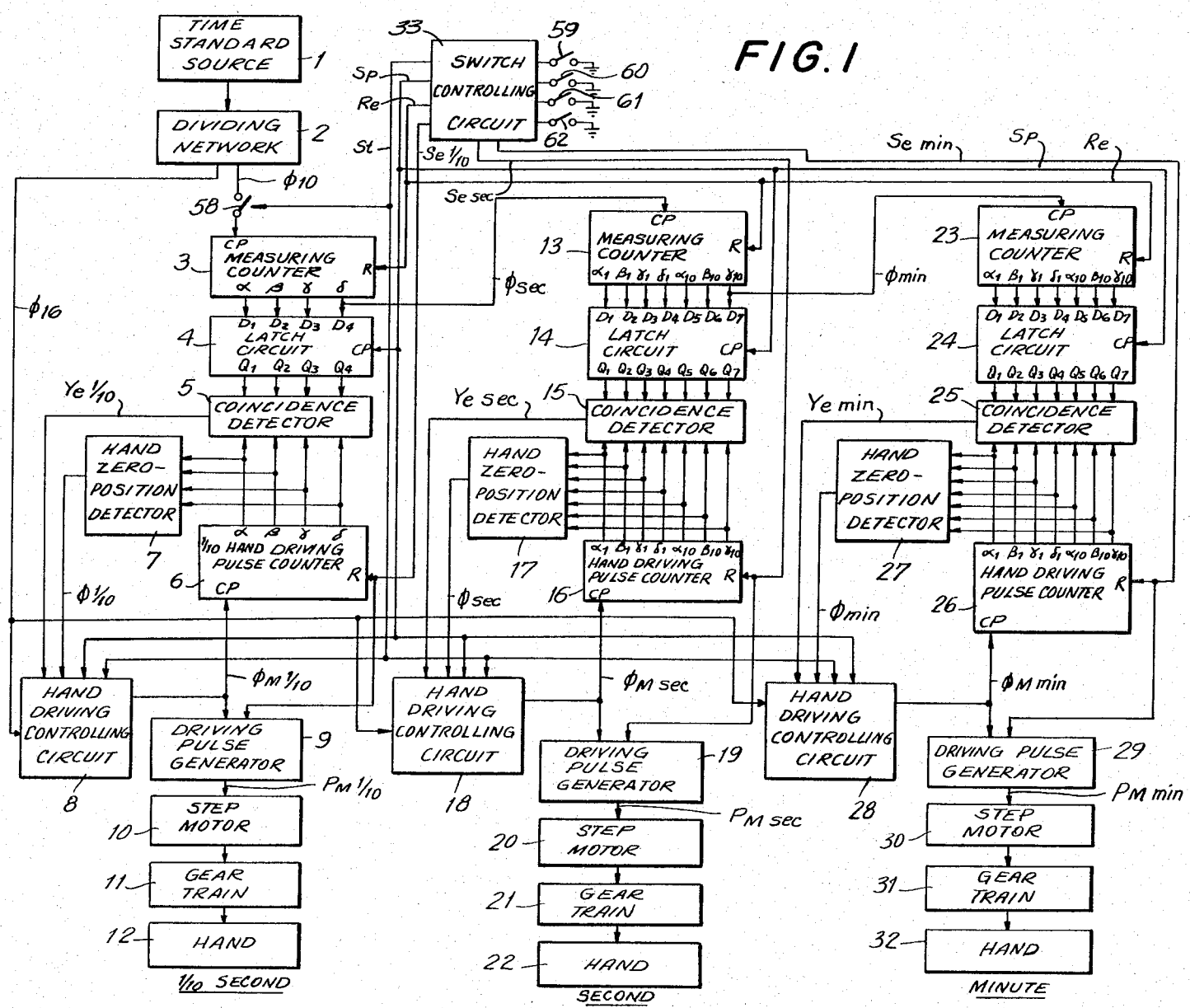
FIG. 1 is a functional block diagram of an analog display stopwatch in accordance with the invention.

FIG. 1 is a block diagram of an analog display stopwatch in accordance with the invention. In FIG. 1 elements 3–12 are necessary for displaying time in the 1/10th second unit, elements 13–22 are necessary for displaying in the seconds unit, and elements 23–32 are necessary for displaying time in the minute unit.

The analog display stopwatch includes a time standard source 1 which is constructed of a quartz crystal vibrator and an oscillation circuit generating a time standard signal of 32768 Hz. A divider network 2 divides the time standard signal of 32768 Hz in steps and generates a signal $\phi$16 at 16 Hz and a time measurement standard signal $\phi$10 of 10 Hz. A switch 58 is closed at the time when a signal St (for commanding a start and stop of time measurement) from a switch controlling circuit 33 is in the high state.

The following is a description of the functional blocks necessary for displaying time in the 1/10th second unit, including a 1/10th second measuring counter 3 of a decimal system. The state of outputs, $\alpha$, $\beta$, $\gamma$, and $\delta$ change in the counter 3 depending on the fall of a clock signal being input to a clock terminal Cp. The 1/10th second measuring counter 3 counts a time measurement standard signal $\phi$10 of 10 Hz and is reset by a signal Re for commanding a return-to-zero which is applied from the switch controling circuit 33.

A latch circuit 4 holds data D1, D2, D3, D4 where the split signal Sp is in a high state at the time of the rise of a split signal Sp for commanding to display the split time, the split signal Sp being delivered from the switch controlling circuit 33 to the input terminal Cp of the measuring counter 3.

In a coincidence detector 5, the contents Q1, Q2, Q3, Q4 of the latch circuit 4 are compared with the contents $\alpha$, $\beta$, $\gamma$, $\delta$, of a 1/10th second hand driving pulse counter 6. When these contents coincide with each other, a coincidence signal Ye 1/10 at a high level is delivered from the detector 5. When there is no coincidence in the detector 5, the coincidence signal Ye 1/10 delivers a low signal. The 1/10th second hand driving pulse counter 6 for memorizing the indicated position of a 1/10th second hand 12, is constructed in much the same manner as the 1/10th second hand measuring counter 3. The counter 6 counts the motor driving signal $\phi$M 1/10 for driving the 1/10th second hand 12 and is reset when the signal Se 1/10, that is the 1/10th second hand set signal, delivered from the switch controlling circuit 33, is supplied to the reset terminal R. Thus the zero-position of the 1/10th second hand is memorized.

A detector 7 detects the zero-position of the 1/10th second hand and therefrom a 1/10th second hand zero-position signal 01/10 is high at the time when the 1/10th second hand 12 indicates zero-position and is low at the time when the hand is not at the zero-position.

A controlling circuit 8 for controlling the driving of the 1/10th second hand, generates a signal $\phi$16 of 16 Hz as a motor driving signal $\phi$M 1/10 under the following conditions respectively. Namely, when a start/stop signal St is high, a split signal Sp is low, and the 1/10th second hand zero-position signal 01/10 is low. The other case occurs when the start/stop signal St is low or a split signal Sp is high and the coincidence signal Ye 1/10 is low.

When a motor driving signal $\phi$M 1/10 or 1/10th second hand set signal Se1/10 is input to a driving pulse generator 9, a step motor driving pulse PM 1/10 for driving a step motor 10 is generated in accordance with each inputted signal. The step motor 10 is driven by the step motor driving pulse PM 1/10, and a gear train 11, interlocking with the step motor 10, is constructed so that the 1/10th second hand 12 circulates with 10 steps per revolution. The 1/10th second hand 12 displays the time in units of 1/10th second.

Hereinafter, functional blocks for displaying the time in the seconds unit are explained. As operation of each functional block is the same as that of the corresponding functional blocks necessary for displaying the time in the 1/10th second unit, the following explanation is abbreviated.

In a sexagesimal second measuring counter 13, a 1 Hz signal $\phi$sec delivered from the 1/10th second measuring counter 3 is counted. A latch counter 14 passes and holds the contents of the second measuring count of 13 and a coincidence detector 15 detects whether the contents of the latch circuit 14 and a second hand driving pulse counter 16 are coincident with each other or not coincident. The sexagesimal second hand driving pulse counter 16 stores data of the indicated position of a second hand 22. A second hand zero-position detector 17 from which a second hand zero-position signal O sec at a high is generated when the second hand 22 indicates the zero-position, and generates a low when the second hand 22 indicates any position other than the zero-position.

A second hand driving controlling circuit 18 is constructed in much the same manner as the 1/10th second hand driving controlling circuit 8 and a driving pulse generator 19 has substantially the same construction as that of the driving pulse generator 9 and generates a step motor driving pulse PM sec according to a motor driving signal $\phi$M sec delivered from the second hand driving controlling circuit 18. Than a second hand set signal Se sec is delivered from a switch controlling circuit 33. A step motor 20 and a gear train 21 are constructed such that the second hand 22 circulates with 60 steps.

Functional blocks necessary for displaying the time in the minute unit are described hereinafter. However, each functional block is constructed quite similarly to the blocks necessary for displaying the time in the second unit. Therefore, the description which follows is briefly presented.

A sexagesimal minute measuring counter 23 counts 1/60 Hz signal $\phi$min delivered from the second measuring counter 13. Also included are a latch circuit 24 and a coincidence detector 25 for detecting whether the contents of the latch circuit 24 coincide with that of a minute hand driving pulse counter 26. The minute hand driving pulse counter 26 memorizes the indicated position of a minute hand 32. A minute hand zero-position detector 27 indicates whether or not the minute hand is at the zero-position. A minute hand driving controlling circuit 28 controls the driving of the minute hand 32 and is constructed in quite the same manner as the 1/10th second hand driving controlling circuit 8 and the second hand driving controlling circuit 18. A driving pulse generator 29 outputs step motor driving pulses PM min in response to a motor driving signal $\phi$M min and a minute hand set signal Se min. A step motor 30, and gear train 31 are constructed for driving the minute hand 32.

From the switch controlling circuit 33, a start/stop signal St, a split signal Sp, a reset signal Re, a 1/10th second hand set signal Se1/10, a second hand set signal Se sec and a minute hand set signal Se min are output in response to operations of external operating means 59–62.

In the analog display stopwatch in accordance with the invention when external operating means 62 is open, this embodiment is in the time measurement mode. By closing the outer operating means 59, the logic of the start/stop signal St changes cyclically. By closing the outer operating means 60 under a condition where St is high, causes the logic of the split signal Sp to change cyclically. Further, by closing the outer operating means 61, a reset signal Re goes to a high state. When the outer operating means 62 being closed this embodiment is in the zero-position correcting mode. By operation of the outer operating means 59 and the outer operating means 60 and the outer operating means 61, a 1/10th second hand set signal Se 1/10, a second hand set signal Se sec and a minute hand set signal Se min are respectively generated. Other constructions for the switch controlling circuit 33 are available but are not discussed in detail herein.

Figure 2:
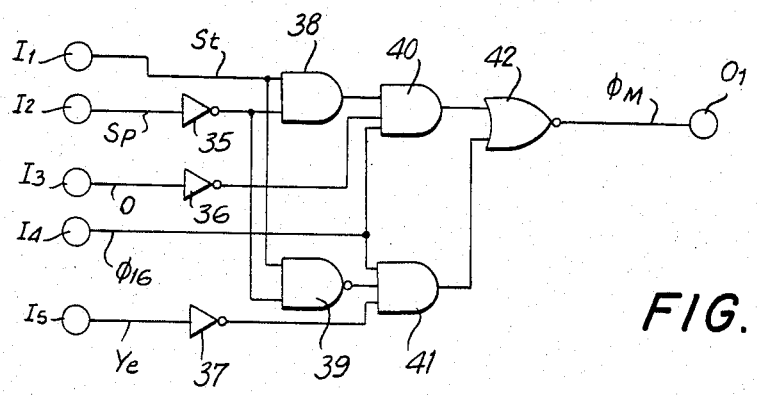
FIG. 2 is a circuit for particular components in the functional diagram of FIG. 1.

FIG. 2 illustrates an actual construction which can operate as a 1/10th second hand driving controlling circuit 8, a second hand driving controlling circuit 18 and a minute hand controlling circuit 28 respectively in FIG. 1. The circuit of FIG. 2 includes inverters 35, 36, 37, AND gates 38, 40, 41, NAND gate 39 and a NOR gate 42. To each terminal I1–I5 in FIG. 2, the following signals are respectively applied. Namely, the start/stop signal St delivered from the switch controlling circuit 33 in FIG. 1 is inputted to the terminal I1. A split signal Sp is inputted to the terminal I2. The zero-position detecting signal O output from the detectors 7, 17, 27 for detecting the zero-position of each hand in FIG. 1 respectively, is applied to the terminal I3. A signal $\phi$16 of 16 Hz delivered from the divider network 2 in FIG. 1 is applied to the terminal I4, and a coincidence signal Ye delivered from each coincidence detector 5, 15, 25 respectively in FIG. 1, is applied to the terminal I5.

With the above circuit construction, for the 1/10th second hand driving controlling circuit 8, the zero-position detector O is O1/10 and the coincidence signal Ye is Ye1/10. Further, for the second hand driving controlling circuit 13, the zero-position detector O is O sec, and the coincidence signal Ye is Ye sec. Furthermore, for the minute hand driving controlling circuit 28, the zero-position detector O is O min and the coincidence signal Ye is Ye min.

With reference to FIG. 2, when the start/stop signal St is high, split signal Sp is in a low state and the zero-position detecting signal O is in a low state by way of AND gate 40, a signal $\phi$16 of 16 Hz is selected as the motor driving signal $\phi$M. Further, by way of AND gate 41, also when the start/stop signal St is in the low state or the split signal Sp is in the high state and the coincidence signal Ye is in the low state, the signal $\phi$16 of 16 Hz is selected as the motor driving signal $\phi$M. Namely, even if the time measurement is started, that is, even if St goes to the high state, in so far as a signal for commanding a stop to the time measurement (St is in a low state) or a signal commanding to display the split time (Sp is in the high state) is not applied, the hand remains stationary, indicating the zero-position.

When either of the above signals is applied, that is, St goes to the low state or Sp goes to the high state, the hand is driven with 16 Hz until the indicated position of the hand, that is, the content of the hand driving pulse counter, coincides with the content of the latch circuit, that is, until the coincidence signal Ye goes to the high state.

When the signal for commanding to display of the split time is released, that is, when Sp goes to the low state, the hand is moved to the zero-position with a 16 Hz signal through the AND gate 40. Further, contrary to the above, when the signal for commanding a start of time measurement again, that is, St is in the high state, is applied, the hand is also moved to the zero-position with 16 Hz. Furthermore, when time measurement is completed and the signal for commanding a return to zero of the hand is applied, that is, the reset signal Re goes high, the contents of the measuring counter (3, 13, 23) becomes zero and the coincidence signal Ye goes to the low state. Therefore, the hand indicates the zero-position by way of the AND gate 41, that is, the content of the hand driving pulse counter becomes zero and then the hand is driven with a 16 Hz signal until coincidence signal Ye goes to the high state.

As is apparent from FIGS. 1 and 2, step motors 10, 20, 30 for respectively driving the 1/10th second hand 12, second hand 22 and minute hand 32, are not driven under normal circumstances. The above step motors, 10, 20, 30 are driven only when the stop time and the split time are to be displayed or the hand is returned to the zero-position. Therefore, in an analog display stopwatch in accordance with the invention, power required for driving the step motor is extremely low.

In this embodiment, at first all hands indicate a zero-position when time is being measured and then the measured time is displayed in response to a signal for commanding a stop to measurement or a signal for commanding a display of split time. However, when there is enough battery capacity, it is possible to construct the second hand driving controlling circuit 18 and the minute hand driving controlling circuit 28 so that the measured times of the second time 22 and of the minute hand 32 are displayed progressively at all times of measurement.

Also, in the above embodiment, there is no description or structure for display of an hour time unit. However, an hour time unit can be displayed by means of a similar structure as used for displaying another unit. In this embodiment, with regard to a unit less than one second, it is constructed so as to display the unit of 1/10th seconds. By means of a similar structure, a unit of 1/20th seconds, 1/50th seconds or 1/100th seconds can also be displayed.

An alternative embodiment of an analog display stopwatch in accordance with the invention is described in detail hereinafter. In this alternative embodiment, an analog display stopwatch has the following functions. In particular, for the first ten minutes after starting of time measurement, a hand always displays measurement in time continuously. After ten minutes have passed since the start of the time measurement, the hand operates in the same manner as in the above described embodiment, that is, the hand is stationery until a stop is commanded or a split time readout is commanded in time measurement.

FIG. 3 is a functional block diagram of the alternative embodiment. In comparison between FIGS. 1 and 3, there are the following three different features. First, in FIG. 3, a ten minute detector 34 is provided for detecting whether or not ten minutes have passed since starting of time measurement. Second, a ten minute detecting signal 10 min from the ten minute detecting circuit 34 is input to the driving controlling circuits (8, 18, 28) for each hand. This ten minute detecting signal 10 min is in a low state during the time period which is less than the first ten minutes after the time measurement is initiated, and becomes high after an elapsed time of ten minutes from the starting of the time measurement. Third, in addition to the signal $\phi$16 of 16 Hz, a signal $\phi$10 of 10 Hz is applied to the 1/10th second hand driving controlling circuit 8. Also, concerning the second hand driving controlling circuit 18, a signal $\phi$sec of 1 Hz is applied thereto in addition to the signal $\phi$16. Further, to the minute driving controlling circuit 28, a 1/60 Hz signal $\phi$ is applied in addition to the signal $\phi$16.

Figure 4:
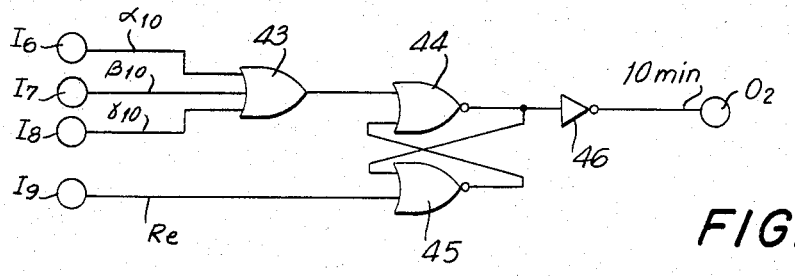
FIG. 4 and FIG. 5 are circuits of particular functional blocks of FIG. 3.

FIG. 4 shows an actual circuit for a ten minute detector 34. The circuit of FIG. 4 includes an OR gate 43, NOR gates 44, 45 and an inverter 46. A R-S flip-flop is constructed from the above NOR gates 44,45. The terminals I6, I7 and I8 are connected respectively with the $\alpha$10 terminal, $\beta$10 terminal and $\gamma$10 terminal of the minute measuring counter 23. A reset signal Re is applied to the terminal I9, delivered from the switch controlling circuit 33.

In FIG. 4, when the time measurement comes to an end and the signal for commanding return-to-zero of each hand (reset signal Re) is applied to the terminal I9, the minute measuring counter 23 is also reset by the reset signal Re. At this time, as $\alpha$10, $\beta$10, and $\gamma$10 are all in a low state, a signal 10 min applied to the terminal O2 goes surely to the low state. When the elapsed time is greater than ten minutes and $\alpha$10 goes to the high state, a ten minute detecting signal 10 min also goes to the high state and this does not change to a low state until the reset signal Re is applied to the terminal I9 again. Accordingly, the ten minute detecting signal 10 min is in the low state until ten minutes elapse from the start of the time measurement and goes to the high state after ten minutes from the start of the time measurement.

Figure 5:
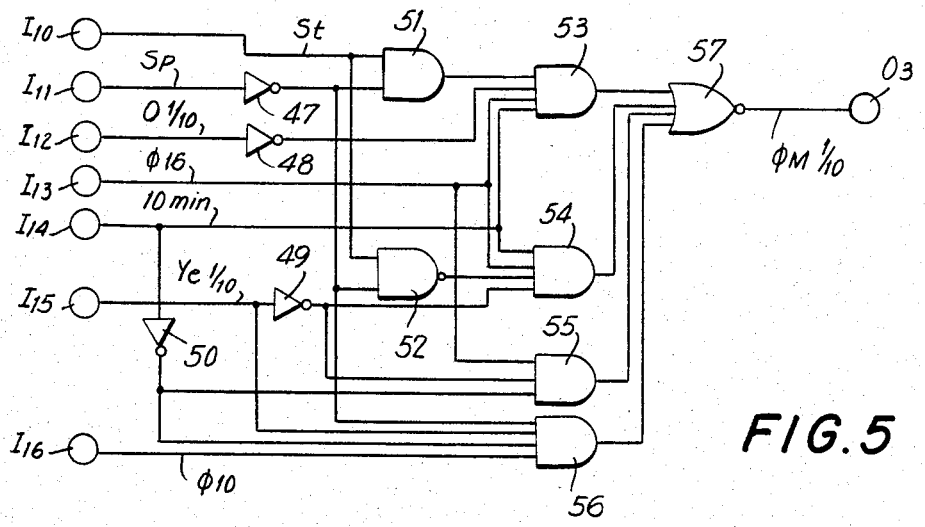

FIG. 5 illustrates an actual construction of a 1/10th second hand driving circuit in FIG. 3. The circuit of FIG. 5 includes AND gates 51, 53, 54, 55, 56, NAND gate 52 and NOR gate 57. The following signals are applied respectively to each terminal I10–I12,I14–I16. Namely, a start/stop signal St is applied to I10, a split signal Sp is applied to terminal I11, a 1/10th second hand zero-position detecting signal O-1/10 is applied to terminal I12, a ten minute detecting signal 10 min is applied to terminal I14, a coincidence signal Ye 1/10 is applied to terminal I15 and a signal $\phi$10 of 10 Hz is applied to the terminal I16.

In the circuit of FIG. 5, AND gates 53, 54 control operation of the hands after ten minutes from the start of time measurement. This is quite the same construction as that of FIG. 2 except that the ten minute detecting signal 10 min is applied. AND gates 55, 56 control operation of the hands when elapsed time is less than ten minutes. When the coincidence circuit signal Ye 1/10 is in a low state, a signal $\phi$16 of 16 Hz is selected as the motor driving signal $\phi$M 1/10 and when the coincidence circuit signal Ye 1/10 is in a high state and the split signal Sp is in a low state, a signal $\phi$10 of 10 Hz is selected as the motor driving signal $\phi$M 1/10. Accordingly, the hand 12 (FIG. 3) is driven at 10 Hz when elapsed time is less than ten minutes from the start of time measurement and is stopped when the split time is displayed. And when the state displaying the split time is released, the hand moves with a quick feed at 16 Hz until the coincidence signal Ye 1/10 goes to a high state. The hand is stopped by a stop signal and at the time of return-to-zero, the hand returns to the zero-position with a quick feed at 16 Hz and then displays the measured time at all times.

The second hand driving controlling circuit 18 and the minute hand driving controlling circuit 28 in FIG. 3 have substantially similar structures as those illustrated in FIG. 5. In this structure, instead of O-1/10, Ye 1/10, $\phi$10 and $\phi$M 1/10, respectively, O sec and O min, Ye sec and Ye min, $\phi$sec and $\phi$min and $\phi$M sec and $\phi$M min are delivered. As is apparent from FIGS. 3, 4, 5, when elapsed time is less than ten minutes from the start of time measurement, the step motor 10, 20, 30 for driving the 1/10th second hand 12, the second hand 22 and the minute hand 32 respectively, are driven at all times except during the time of a split display state. But when elapsed time exceeds ten minutes from the start of time measurement, the step motors are driven in the same operating periods as described for the embodiment of FIG. 1. Therefore, the power required for driving step motors is satisfied using very little energy. In this case, as all hands move for the first ten minutes after starting time measurement, the user is satisfied visually. Energy is only conserved for operations beyond ten minutes.

Then, in this alternative embodiment, the 1/10th second hand driving controlling circuit 8, the second hand driving controlling circuit 18 and the minute hand driving controlling circuit 28 of FIG. 3 which are constructed very similar one to the other, and all hands return to the zero-position after ten minutes elapse from the beginning of time measurement. However, when there is sufficient battery capacity, it is possible to construct the second hand driving controlling circuit 18 and the minute hand driving controlling circuit 28 so as to display measured time by the second hand 22 and the minute hand 32 at all times.

In this altenative embodiment, the hands are moved appropriately on the basis of ten minutes, that is, whether the elapsed time is more or less than ten minutes. But the basis of time does not have to be ten minutes, it can be set at any time suitable to the battery capacity and the intended use of the analog display stopwatch.

In this alternative embodiment, there is no description of a structure for displaying an hour unit. Of course, it is possible to display the hour unit by means of a similar construction as that for displaying the other units.

As described above, in an analog display stopwatch in accordance with the invention, because the motor is driven with extremely low power, a small battery can be used. As a result, an analog display stopwatch having the size of a conventional wristwatch, or the like, is provided.

Another alternative embodiment of an analog display stopwatch in accordance with the invention relates to a construction to reduce the power consumption at the time when the battery life is about to be exhausted and to a battery life indication for an analog display stopwatch.

Recently, an analog display stopwatch having a quartz crystal oscillator as a time standard source and a plurality of step motors for driving hands to indicate the elapsed time has been developed instead of the conventional mechanical stopwatch. However, driving a step motor consumes 1.5 to 3 $\mu$W of power for each step, which is much greater than driving a CMOS-IC, or the like. Accordingly, for example, a step motor for driving a hand displaying time in 1/20th second units requires 20 to 40 μA every second.

The voltage of a silver oxide battery usually used in a watch remains stable at about 1.58 V and drops rapidly when the capacity of the battery is about to be exhausted. The capacity of the battery at the time when the voltage begins to diminish is 0.2 to 0.3 mAH. This is only 5 hours of capacity to drive step motors consuming 40 μA per second. The period from the beginning of the voltage reduction to exhaustion of the battery life is so short that the user of an analog display stopwatch may not be aware of a degenerating condition of the battery even if it is displayed in a conventional manner, that is, for example, by advancing the second hand by two second sections on the face of the watch at intervals of two seconds. Or, if the user is aware of a degenerating condition of the battery voltage, the remainder of useful life of the watch battery is so little that a serious inconvenience is incipient, especially in athletic meets, contests and the like.

An object of this invention is to eliminate the above mentioned shortcomings by reducing power consumption near the end of the battery life to prolong the time from the beginning of the voltage reduction until the end of battery life so that the user can be aware that the termination of the battery life is approaching.

This invention is described in detail with reference to the following embodiment. In this embodiment, (FIG. 6) power consumption near the end of battery life is reduced by controlling the driving of a step motor for driving a hand indicating time under one second (the 1/20th second units in this case), which consumes most power.

In FIG. 6 a time standard source 101 comprises a quartz crystal oscillator and produces a signal of 32768 Hz. A divider network 102 divides the time standard signal of 32768 Hz in steps and generates a time measurement standard signal $\phi$20 of 20 Hz and a signal $\phi$16 of 16 Hz which is used to drive hands at the time when a return-to-zero is commanded or a split time display is released. The circuit includes a switch controlling circuit 107 and according to the combination of operations of external operating members 103, 104, 105 and 106, generates different kinds of signals, that is, a start/stop signal St for commanding start and stop of time measurement, a split signal Sp for commanding to display the intermediate elapsed time (the split time) and to release the display, a reset signal Re for commanding each hand to return to zero, and a 1/20th second hand set signal Se 1/20, a second hand set signal Se sec and a minute hand set signal Se min for commanding to correct the positions of the 1/20th second hand, the second hand and the minute hand to indicate zero respectively.

The switch controlling circuit 107 is constructed to function as follows. When the external operating member 106 is open, this embodiment is in the stopwatch mode. By operating the external operating member 103, the logic state of a start/stop signal St changes cyclically. By operating the external operating member 104 at a time when the start/stop signal St is in the high state, the logic state of the split signal Sp changes cyclically. By operating the external operating member 105, the logic state of the reset signal Re goes from low to high momentarily. In this case, when the reset signal Re is in the high state, the start/stop signal St and the split signal Sp are always in the low state.

When the external operating member 106 is closed, this embodiment is in the zero-position correcting mode. By operating the external operating member 103, the logic state of the 1/20th second hand set signal Se 1/20 goes from low to high momentarily. By operating the external operating member 104, the logic state of a second hand set signal Se sec goes from low to high momentarily. By operating the external operating member 105, the logic state of the minute hand set signal Se min goes from low to high momentarily.

A switch 108 closes only when the start/stop signal St applied thereto is in the high state. The circuit includes a battery voltage detector 109 for detecting the battery voltage at regular intervals and outputs a battery life signal BLD which becomes high when the detected voltage is 1.4 V or less. The timing for detecting the battery voltage does not coincide with the timing for driving each step motor.

In FIG. 6 are elements 110–119 necessary for displaying time in the 1/20th second units. A 1/20th second measuring counter 110 is a 1/20 counter for counting the time measurement standard signal $\phi$20 of 20 Hz. The 1/20th second measuring counter 110 is reset when a reset signal Re applied thereto becomes high. There is a latch circuit 111. When a split signal Sp applied thereto rises low to high the latch circuit 111 holds the content of the 1/20th second measuring counter 110 and passes the content thereof when Sp is low. A coincidence detector 112 detects the coincidence of the content of the latch circuit 111 and that of the 1/20th second hand driving pulse counter 113 and generates a 1/20th second coincidence signal Ye 1/20. The 1/20th second coincidence signal Ye 1/20 becomes high when the contents of the latch circuit 111 and the 1/20th second hand driving pulse counter 113 coincide with each other and becomes low when the contents thereof do not coincide.

The 1/20th second hand driving pulse counter 113 is a 1/20 counter for counting the 1/20th second hand driving signal $\phi$M 1/20 and stores the information of the position where the 1/20th second hand 119 indicates. The 1/20th second hand driving pulse counter 113 is reset when a 1/20th second hand set signal Se 1/20 applied thereto becomes high. A 1/20th second hand zero-position detector 114 generates a 1/20th second hand zero-position signal O 1/20, which becomes high only when all outputs ($\alpha$, $\beta$, $\gamma$, $\delta$ and $\epsilon$) of the 1/20th second hand driving pulse counter 113 are in the low state.

The 1/20th second hand driving controlling circuit 115 selects a 20 Hz signal $\phi$20 or a 16 Hz signal $\phi$16 as a 1/20th second hand driving signal $\phi$M 1/20 according to the logic states of a start/stop signal St, a split signal Sp, a 1/20th second coincidence signal Ye 1/20, the 1/20th second hand zero-position signal O 1/20 and a battery life signal BLD. A driving pulse generator 116 generates a driving pulse PM 1/20 for driving a step motor 117 with response to either the 1/20th second hand driving signal $\phi$M 1/20 or the 1/20th second hand set signal Se 1/20. A gear train 118 is interconnected with the step motor 117 and is constructed so that the 1/20th second hand 119 completes one rotation with 20 steps.

In FIG. 6 elements 120–128 are necessary for displaying time in seconds. A second measuring counter 120 is a 1/60 counter for counting a 1 Hz signal $\phi$sec output from the 1/20th second measuring counter 110. The second measuring counter 120 is reset when a reset signal Re becomes high. When a split signal Sp rises from low to high, a latch circuit 121 holds the content of the second measuring counter 120 and passes the content thereof when Sp is low. A coincidence detector 122 detects the coincidence of the content of the latch circuit 121 and that of the second hand driving pulse counter 123 and generates a second coincidence signal Ye sec. The second coincidence signal Ye sec becomes high when the contents of the latch circuit 121 and the second hand driving pulse counter 123 coincide with each other and becomes low when the contents thereof do not coincide. The second hand driving pulse counter 123 is a 1/60 counter for counting second hand driving signal $\phi$M sec and stores the information indicating the position of the second hand 128. The second hand driving pulse counter 123 is reset when a second hand set signal Se sec becomes high.

A second hand driving controlling circuit 124 selects a 1 Hz signal $\phi$sec or a 16 Hz signal $\phi$16 as a second hand driving signal $\phi$M sec according to the logic states of a split signal Sp and a second coincidence signal Ye sec. A driving pulse generator 125 generates a driving pulse PM sec for driving a step motor 126 in response to either the second hand driving signal $\phi$M sec or the second hand set signal Se sec. A gear train 127 is interconnected with the step motor 126 and is constructed so that the second hand 128 completes one rotation with 60 steps.

In FIG. 6 elements 129–137 are necessary for displaying time in minutes. A minute measuring counter 129 is a 1/60 counter for counting a 1/60 Hz signal $\phi$min output from the second measuring counter 120. The minute measuring counter 129 is reset when a reset signal Re becomes high. When a split signal Sp rises from low to high, a latch circuit 130 holds the content of the minute measuring counter 129 and passes the content when Sp is low. A coincidence detector 131 detects the coincidence of the content of the latch circuit 130 and that of the minute hand driving pulse counter 132 and generates a minute coincidence signal Ye min. The minute coincidence signal Ye becomes high when the contents of the latch circuit 130 and the minute hand driving pulse counter 132 coincide with each other and becomes low when the contents thereof do not coincide. The minute hand driving pulse counter 132 is a 1/60 counter for counting a minute hand driving signal $\phi$M min and stores the information of the position of the minute hand 137. The minute hand driving pulse counter 132 is reset when a minute hand set signal Se min becomes high. The minute hand driving controlling circuit 133 selects a 1/60 Hz signal $\phi$min or a 16 Hz signal $\phi$16 as the minute hand driving signal $\phi$M min according to the logic states of a split signal Sp and a minute coincidence signal Ye min. A driving pulse generator 134 generates a driving pulse PM min for driving a step motor 135 in response to either the minute hand driving signal $\phi$M min or a minute hand set signal Se min. A gear train 136 is interconnected with the step motor 135 and is constructed so that the minute hand 137 completes one rotation with 60 steps.

Figure 7:
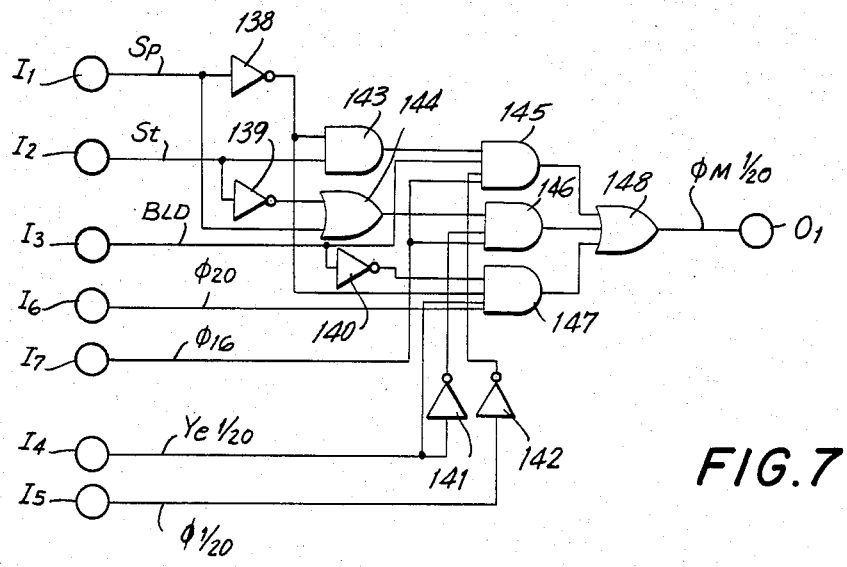
FIG. 7 is a circuit diagram of a functional block in the diagram of FIG. 6.

FIG. 7 is a circuit diagram of the 1/20th second hand driving controlling circuit 115 in FIG. 6. FIG. 7 includes inverters 138–142, AND gates 143,145,146,147 and OR gates 144,148. Under the condition that the battery life signal BLD input to the terminal I3 is high and a start/stop signal St input to the terminal I2 is high (that is, in the time measuring mode) and a split signal Sp input to the terminal I1 is low (that is, not in the split time display mode) and the 1/20th second hand zero-position signal O 1/20 input to the terminal I5 is low (that is, when the 1/20th second hand does not indicate zero), the AND gate 145 selects a 16 Hz signal $\phi$16 as the 1/20th second hand driving signal $\phi$M 1/20 and the 1/20th second hand is driven at 16 Hz frequency until the 1/20th second hand indicates zero. If a 1/20th second coincidence signal Ye 1/20 input to the terminal I4 is low when a start/stop signal St is low (that is, when a stop of time measurement is commanded) or when a split signal Sp is high (that is, when the split time display is commanded), the AND gate 146 selects a 16 Hz signal $\phi$16 as the 1/20th second hand driving signal $\phi$M 1/20 and the 1/20th second hand is driven at 16 Hz frequency until the 1/20th second hand indicates the elapsed time measured or the split time. When a battery life signal BLD is low and a split signal Sp is low and the 1/20th second coincidence signal Ye 1/20 is high, the AND gate 147 selects a 20 Hz signal $\phi$20 as the 1/20th second hand driving signal $\phi$M 1/20 and the 1/20th second hand is driven at 20 Hz frequency.

By constructing the 1/20th second hand driving controlling circuit 115 in FIG. 6 as described above, during time measurement, the step motor 117 is always driven at 20 Hz frequency except for the period when the split time is displayed in the normal condition of battery voltage (i.e. while the battery life signal BLD is low). When the capacity of the battery is about to be exhausted (i.e. after the battery life signal BLD rises from low to high), the step motor 117 is driven only for the two short periods; that is, from the time when a signal commanding a stop in time measurement is output (i.e. signal St becomes low) or when a signal commanding to display the split time is output (i.e. signal Sp becomes high) until the 1/20th second hand indicates the elapsed time in the 1/20th second units, and from the time when a signal commanding to re-start time measurement is output (i.e. a signal St becomes high) or when a signal commanding a release of the split time display is output (i.e. a signal Sp becomes low) until the 1/20th second hand indicates zero. Thus power consumption near the termination of battery life is greatly reduced compared with that in the normal condition of the battery voltage.

Figure 8:
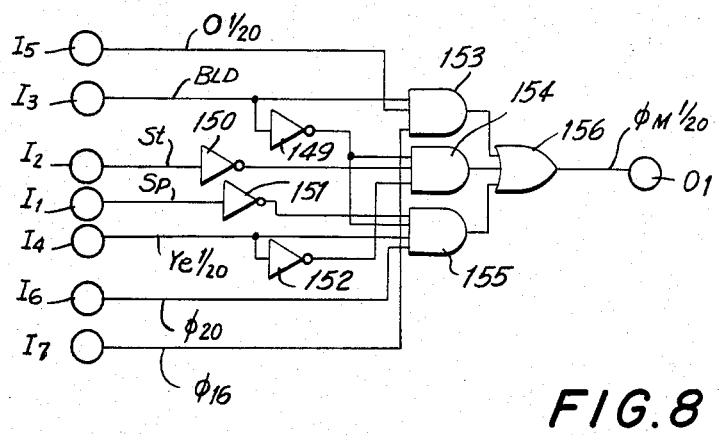
FIGS. 8 and 9 are circuit drawings of functional blocks in the block diagram of FIG. 6.

FIG. 8 is another example of a construction of the 1/20th second hand driving controlling circuit 115 in FIG. 6. The circuit of FIG. 8 includes inverters 149, 150, 151, 152, AND gates 153–155 and an OR gate 156. Signals input to terminals I1 to I5 correspond to those input to terminals I1 to I5 in FIG. 7.

By the structure of the 1/20th second hand driving controlling circuit 115 as shown in FIG. 8, during time measurement, the step motor 117 is always driven at a 20 Hz frequency except for the period when the split time is displayed in the normal condition of the battery voltage (that is, while a battery life signal BLD is low) similar to the structure shown in FIG. 7. However, when the capacity of the battery is about to be exhausted (that is, after a battery life signal BLD rises from low to high), the step motor 117 is not driven after the 1/20th second hand indicates zero. In this way, power consumption near the end of the capacity of the battery is extremely reduced compared with that in the normal condition of the battery voltage.

Figure 9:
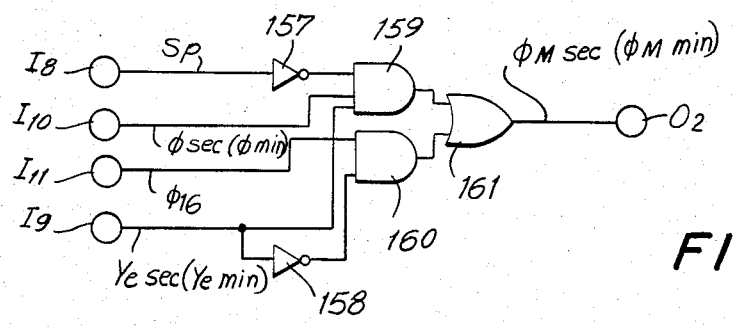

FIG. 9 is a circuit diagram for the second hand driving controlling circuit 124 and the minute hand driving controlling circuit 133 in FIG. 6. FIG. 9 includes inverters 157,158, AND gates 159,160 and an OR gate 161. When the circuit of FIG. 9 is used for the second hand driving controlling circuit 124, a second coincidence signal Ye sec and a 1 Hz signal $\phi$sec are input to the terminals I9 and I10 respectively. Similarly, when the circuit of FIG. 9 is used for the minute hand driving controlling circuit 133, a minute coincidence signal Ye min and a 1/60 Hz signal $\phi$min are input to the terminals I9 and I10 respectively. In both cases, the split signal Sp and a 16 Hz signal $\phi$16 are input to the terminals I8 and I11 respectively.

The hand driving controlling circuit shown in FIG. 9 is constructed so that the hand always indicates the elapsed time measured irrespective of the condition of the battery voltage. Accordingly, the power consumption is constant for the whole battery life. However, the step motor 126 for driving a second hand 128 is driven once a second and a step motor 135 for driving a minute hand 137 is driven once a minute, which requires the minimum of the power source. Therefore, only by controlling the driving of the 1/20th second hand when the termination of the battery life is approaching as mentioned before, the power consumption of a stopwatch becomes much less than that of the conventional stopwatch in which a step motor for driving the 1/20th second hand is driven 20 times a second.

According to this invention as hereinbefore described, when the battery voltage detector detects the degenerating condition of the voltage, the hand stops at the position indicating zero and the step motor is no longer driven. Or when the diminished battery voltage is detected, the step motor is not driven with the hand indicating zero during time measurement, but on a signal commanding to display the split time, the step motor is driven to drive the hand to indicate the elapsed time. Thus, according to this invention, the power consumption needed for driving a step motor is largely reduced. Consequently, the period from the beginning of the battery voltage reduction to the exhaustion of the battery life is prolonged, which permits the user of the stopwatch to have more opportunities to become aware that termination of the battery life is approaching.

Further, as stated above, near the end of the battery life, the hand stays still indicating zero even when time measurement starts, according to this invention. Therefore, no additional means, such as by advancing the second hand by two seconds, is not specially required to alert the user to the degenerating condition of the battery voltage.

In the embodiment (FIG. 6, etc.) described above, the principle of this invention is applied only to the 1/20th second hand. However, if a zero-position detector is provided and a hand driving controlling circuit is constructed in each circuit system of the second hand and the minute hand in accordance with this invention, the second hand and the minute hand are controlled in the same way as the 1/20th second hand, described above, resulting in further reduction of power consumption.

Figure 10:
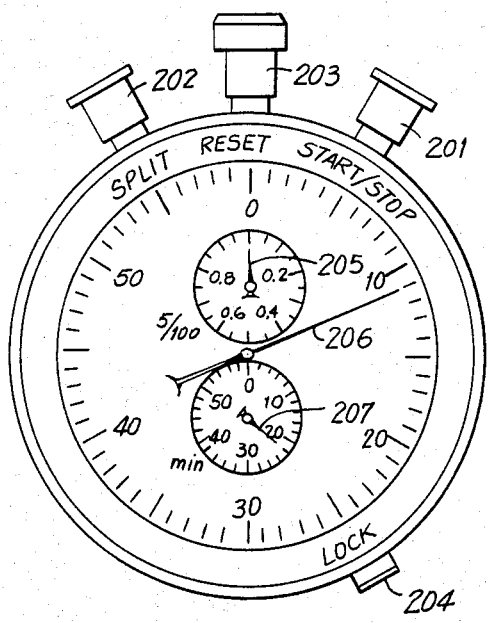
FIG. 10 is a plan view of an analog display stopwatch in accordance with the invention.

Another alternative embodiment of an analog display stopwatch in accordance with the invention is now described in detail. FIG. 10 is a plan view of an analog display stopwatch constructed and arranged in accordance with this invention. In FIG. 10, the 1/20th second hand 205, a second hand 206 and a minute hand 207 are driven by independent step motors respectively. External operating members 201,202,203 are push buttons and an external operating member 204 has two operating positions. When the external operating member 204 is in the first position, the stopwatch is in the time measuring mode. By operating the external operating member 201, start and stop of time measurement is commanded. By operating the external operating member 202, the intermediate elapsed time (split time) display is commanded and by operating the external operating member 203, each hand is commanded to return-to-zero. When the external operating member 204, is in the second position, the stopwatch is in a mode for correcting the hand postion to indicate zero. By operating the external operating member 201, the indicating position of the second hand 206 is corrected, by operating the member 202, the indicating position of the minute hand 207 is corrected and by operating the member 203, the indicating position of the 1/20th second hand 205 is corrected.

Figure 11:
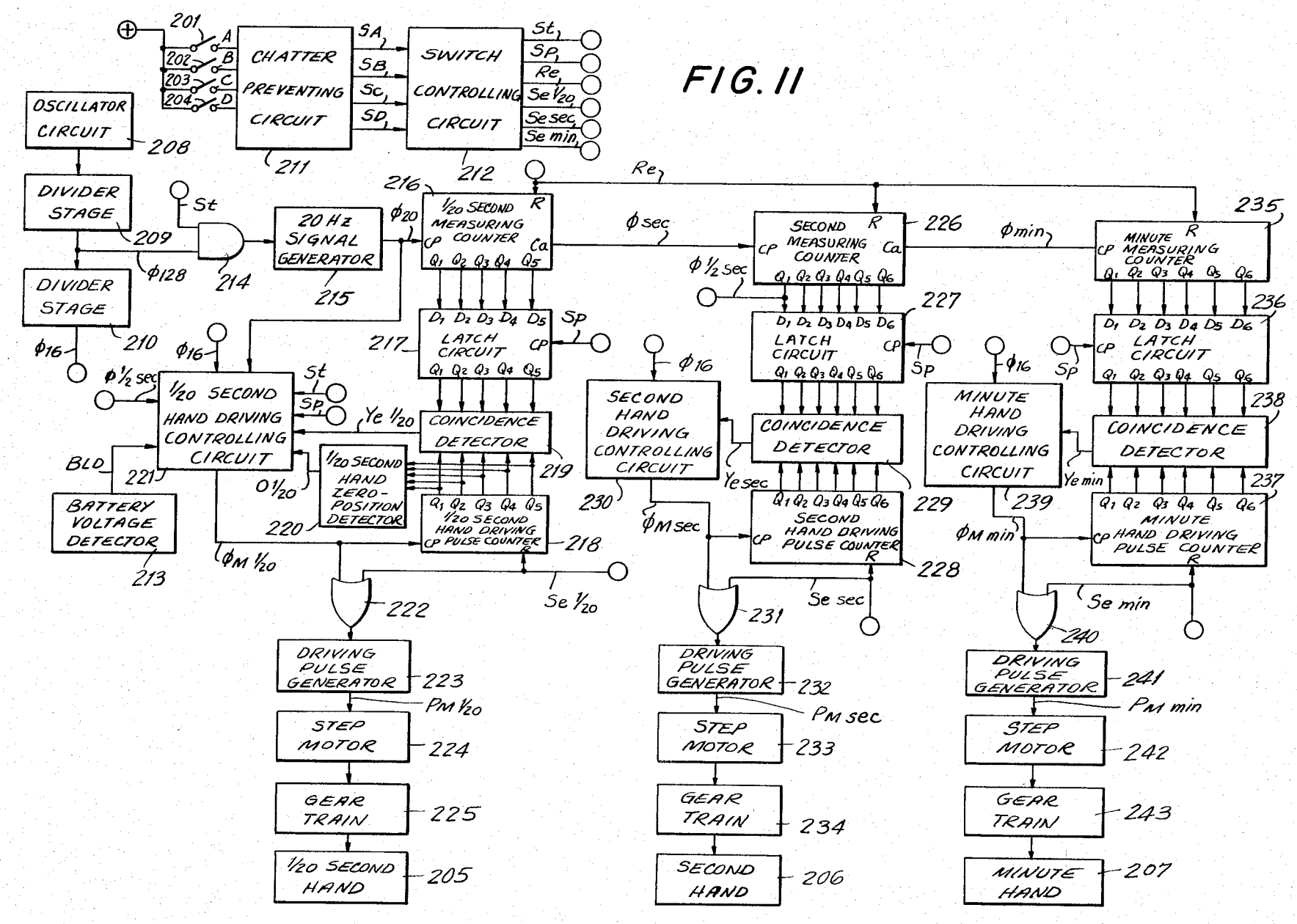
FIG. 11 is a functional block diagram of the electronic circuit for the analog display stopwatch of FIG. 10.

FIG. 11 is a block diagram of an electronic circuit for an embodiment of this invention. An oscillator circuit 208 includes an ultra-small quartz crystal vibrator for producing a high frequency signal of 32768 Hz. A divider stage 209 divides the 32768 Hz signal in stages and outputs a 128 Hz signal $\phi$128. Then a divider stage 210 divides the 128 Hz signal in stages and outputs a 16 Hz signal $\phi$16. A chatter-preventing circuit 211 excludes chattering waveforms of input signals to each switch. Because terminals A, B, C, and D are all held down to the minus electrode, each of outputs $S_A$, $S_B$, $S_C$, and $S_D$ from the chattering preventing circuit 211 are usually low, and become high when the corresponding switch, that is, the external operating member 201 for $S_A$, member 202 for $S_B$, member 203 for $S_C$ and member 204 for $S_D$, is closed.

A switch controlling circuit 212 in accordance with a combination of operations of external operating members 201–204, generates different kinds of signals, that is, a start/stop signal St for commanding start and stop of time measurement, a split signal Sp for commanding to display the split time and to release the display, a reset signal Re for commanding the return-to-zero of each hand, a 1/20th second hand set signal Se 1/20 for correcting the position of the 1/20th second hand 205 to indicate zero, a second hand set signal Se sec for correcting the position of the second hand 206 to indicate zero, and a minute hand set signal Se min for correcting the position of the minute hand to indicate zero.

When the external operating member 204 is open, this embodiment is in the time measurement mode. By operating the external operating member 201, the logic state of a start/stop signal St changes cyclically. By operating the external operating member 202 when a start/stop signal St is high the logic state of a split signal Sp changes cyclically. By operating the external operating member 203, the logic state of a reset signal Re goes from low to high momentarily.

When the external operating member 204 is closed, this embodiment is in the zero-position correcting mode in which the position of a hand is corrected to indicate zero. The logic states of a second hand set signal Se sec, a minute hand set signal Se min and a 1/20th second hand set signal Se 1/20 go from low to high momentarily by operating the external members 201, 202, 203, respectively.

A battery voltage detector 213 detects the battery voltage at regular intervals and outputs a battery life signal BLD which is usually low and becomes high when the detected voltage is 1.4 V or less. An AND gate 214 performs ON/OFF control by passing a 128 Hz signal output from the divider stage 209 only when a start/stop signal St from the switch controlling circuit 212 is high. A 20 Hz signal generator 215 divides down a 128 Hz signal $\phi$128 from the AND gate 214 by combining two dividing rates of 1/6 and 1/7 and generates a 20 Hz signal $\phi$20 as a time measurement standard signal.

In FIG. 11 elements 205, 216–225 are necessary for displaying time in 1/20th second units. The 1/20th second measuring counter 216 is a 1/20 counter for counting a 20 Hz signal $\phi$20 and is reset when a reset signal Re output from the switch controlling circuit 212 is high. When the split signal Sp is low, a latch circuit 217 passes the content of the 1/20th second measuring counter 216 and holds the content thereof when Sp rises high. The 1/20th second hand driving pulse counter 218 is a 1/20 counter for counting a 1/20th second hand driving signal $\phi$M 1/20 output from the 1/20th second hand driving controlling circuit 221 to store the information of the position of the 1/20th second hand 205. When a 1/20th second hand set signal Se 1/20 is high, the 1/20th second hand driving pulse counter 218 is reset.

A coincidence detector 219 detects the coincidence of the content of the latch circuit 217 and that of the 1/20th second hand driving pulse counter 218 and generates a 1/20th second coincidence signal Ye 1/20 which becomes high when coincidence therebetween is detected and otherwise is low. A 1/20th second hand zero-position detector 220 detects that the 1/20th second hand 205 indicates zero and generates a 1/20th second hand zero-position signal O 1/20 which becomes high when the content of the 1/20th second hand driving pulse counter 218 represents zero and becomes low under other conditions. The 1/20th second hand driving controlling circuit 221 selects either a 16 Hz signal $\phi$16 output from the divider stage 210 or a 20 Hz signal $\phi$20 output from the 20 Hz signal generator 215 as the 1/20th second hand driving signal $\phi$M 1/20 according to the logic states of a start/stop signal St and a split signal Sp from the switch controlling circuit 212, a 1/20th second coincidence signal Ye 1/20 from the coincidence detector 219, a 1/20th second hand zero-position detector 220, a $\frac{1}{2}$ Hz signal $\phi\frac{1}{2}$ from the terminal Q1 of the second measuring counter 226 and a battery life signal BLD from the battery voltage detector 213. The 1/20th second hand controlling circuit 221 is described in more detail with reference to FIG. 12 later. A hand driving pulse generator 223 outputs a hand driving pulse PM 1/20 for driving a step motor 224 with response to either a 1/20th second hand driving pulse $\phi$M 1/20 or a 1/20th second hand set signal Se 1/20 output from an OR gate 222. A gear train 225 is interconnected with the step motor 224 and is constructed so that the 1/20th second hand 205 terminates one rotation with 20 steps.

In FIG. 11 elements 226–234 and 206 are necessary for indicating time in seconds. A second measuring counter 226 is a 1/60 counter for counting a 1 Hz signal $\phi$1 output from the 1/20th second measuring counter 216. Counter 226 and is reset when the reset signal Re from the switch controlling circuit 212 becomes high. When a split signal Sp from the switch controlling circuit 212 is low, a latch circuit 227 passes the content of the second measuring counter 226 and holds the content thereof when Sp rises high. A second hand driving pulse counter 228 is a 1/60 counter for counting a second hand driving signal $\phi$M sec output from the second hand driving controlling circuit 230 and stores the information of the position of a second hand 206. The second hand driving pulse counter 228 is reset when a second hand set signal Se sec becomes high. A coincidence detector 229 detects the coincidence of the content of the latch circuit 227 and that of the second hand driving pulse counter 228 and generates a second coincidence signal Ye sec which is high when the coincidence thereof is detected and otherwise low. The second hand driving controlling circuit 230 selects a 16 Hz signal $\phi$16 output from the divider stage 210 as a second hand driving signal $\phi$M sec when a second coincidence signal Ye sec is low. During time measurement, every time when a 1 Hz signal $\phi$1 is input to the second measuring counter 226, the contents of the latch circuit 227 and the second hand driving pulse counter 228 do not coincide with each other. Then, as mentioned above, a second coincidence signal Ye sec becomes low and one 16 Hz signal $\phi$16 passes through the second hand driving controlling circuit 230. Thus the second hand 206 is apparently driven at 1 Hz frequency during time measurement.

At a time when the split time display or stop of time measurement is commanded, the second hand 206 stops and at the time when the split time displayed is released or when time measurement is reset, the second hand 206 is driven at 16 Hz frequency until the contents of the latch circuit 227 and the second hand driving pulse counter 228 coincide with each other. A driving pulse generator 232 generates a driving pulse PM sec for driving a step motor 233 in response to either a second hand driving signal $\phi$M sec or a second hand set signal Se sec output from an OR gate 231. A gear train 234 is interconnected with the step motor 233 and is constructed so that the second hand 206 completes one rotation with 60 steps.

In FIG. 11 elements 235–243 and 207 are necessary for displaying time in minutes. Functioning of every element is the same as that of the corresponding element necessary for displaying time in seconds as described above and therefore is not described here.

Figure 12:
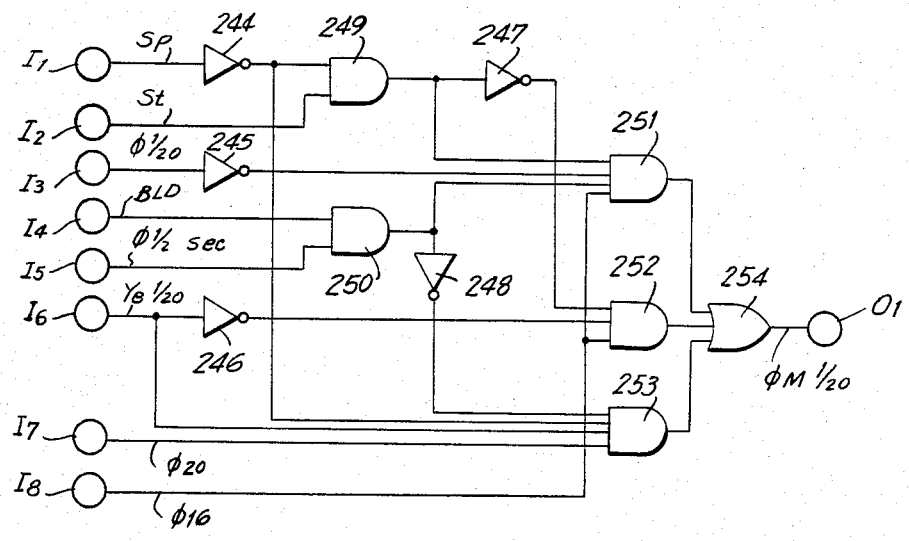
FIG. 12 is a circuit for a functional block in the diagram of FIG. 11.

FIG. 12 is a circuit diagram of a circuit for the 1/20th second hand driving controlling circuit 221 in FIG. 11. FIG. 12 includes inverters 244–248, AND gates 249–253 and an OR gate 254. Signals input to terminals I1, I2, I3, I4, I5, I6, I7 and I8 are a split signal Sp from the switch controlling circuit 212, a start/stop signal St from the switch controlling circuit 212, a 1/20th second hand zero-position signal O 1/20 from the 1/20th second hand zero-position detector 220, a battery life signal BLD from the battery voltage detector 213, a $\frac{1}{2}$ Hz signal $\phi\frac{1}{2}$ output from the terminal Q1 of the second measuring counter 226, a 1/20th second coincidence signal Ye 1/20 from the coincidence detector 219, a 20 Hz signal $\phi$20 from the 20 Hz signal generator 215 and a 16 Hz signal $\phi$16 from the divider stage 210 respectively. The 1/20th second hand driving signal $\phi$M 1/20 is output from the terminal O1 and is fed to the 1/20th second hand driving pulse counter 218 or the OR gate 222 in FIG. 11.

During time measurement (i.e. when the start/stop signal St is high and the split signal Sp is low) and when the battery life is about to be exhausted (i.e. a battery life signal BLD is HIGH) and when the output Q1 of the second measuring counter 226 (a $\frac{1}{2}$ Hz signal $\phi\frac{1}{2}$) is high, and when the 1/20th second hand 205 does not indicate zero (i.e. a 1/20th second hand zero-position signal O 1/20 is low), the AND gate 251 selects a 16 Hz signal $\phi$16 as the 1/20th second hand driving signal $\phi$M 1/20.

When a stop of time measurement is commanded (i.e. a start/stop signal St is low) or when the split time display is commanded (i.e. a split signal Sp is high), if the indicating position of the 1/20th second hand 205 does not coincide with the content of the latch circuit 217 (i.e. a 1/20th second coincidence signal Ye 1/20 is low), the AND gate 252 selects a 16 Hz signal $\phi$16 as the 1/20th second hand driving signal $\phi$M 1/20. During time measurement (when a split signal Sp is low) and when the content of the 1/20th second measuring counter 216 coincides with the indicating position of the 1/20th second hand 205 (the 1/20th second coincidence signal Ye 1/20 is HIGH) and when the battery life signal BLD is low or the output Q1 of the second measuring counter 226 is low, the AND gate 252 selects a 20 Hz signal $\phi$20 as the 1/20th second hand driving signal $\phi$M 1/20.

By constructing the 1/20th second hand driving controlling circuit as described above, when the battery life signal BLD is low, the 1/20th second hand 205 performs as follows. During time measurement, the 1/20th second hand 205 displays the elapsing time. When split time display or stop of time measurement is commanded, the hand 205 stops at the position indicating the split time or the time when time measurement is completed. When the release of the split time display or re-start of time measurement is commanded and the content of the 1/20th second measuring counter 216 coincides with the indicating position of the 1/20th second hand 205, the hand 205 starts to display the elapsing time again.

When return-to-zero of the hand is commanded, the hand 205 is driven at 16 Hz frequency until it indicates zero. While, when the battery life signal BLD is high the performance of the 1/20th second hand 205 is controlled by the logic state of the output Q1 of the second measuring counter 226 (a $\frac{1}{2}$ Hz signal $\phi\frac{1}{2}$). That is, even during time measurement, if the $\frac{1}{2}$ Hz second signal $\phi\frac{1}{2}$ is high, the 1/20th second hand 205 stops at the position indicating zero. Therefore, during time measurement near the end of the battery life, the 1/20th second hand 205 is driven at 20 Hz and stops at the zero-position alternatively every one second. Even if the split time display or stop of time measurement is commanded while the 1/20th second hand 205 stops at the zero-position, the split time or the time when measurement is completed is displayed exactly because of the AND gate 252.

As stated above, in accordance with this invention, the power consumption required for driving the 1/20th second hand near the end of the battery life is reduced to one half of that under the normal condition of the battery voltage. Moreover, since the 1/20th second hand, which moves most frequently among the hands, shows unusual performance, the user of the stopwatch has more opportunities to be aware of the degenerating condition of the battery voltage than, for example, by advancing the second hand by two second sections on the face of the watch at intervals of two seconds.

In the embodiment of FIG. 12, movement of the 1/20th second hand 205 is controlled only by the logic state of the output Q1 of the second measuring counter 226 as an example. However, if other outputs of the second measuring counter 226 or the outputs of the minute measuring counter 235 are utilized, the power consumption required for driving the 1/20th second hand 205 near the end of the battery life can be further reduced. For example, the circuit is arranged so that the output Q1 of the second measuring counter 226 and the output Q1 of the minute measuring counter 235 are input to an OR gate and the output thereof is fed to the terminal I5 in FIG. 12. During time measurement, for one minute in which the output Q1 of the minute measuring counter 235 is low, the 1/20th second hand 205 repeats advancing at 20 Hz and stopping at the position indicating zero every second, and for another one minute in which the output Q1 of the minute measuring counter 235 is high, the 1/20th second hand 205 is at a standstill indicating zero. Thus the power consumption required for driving the 1/20th second hand 205 near the end of the battery life is reduced to one fourth of that under the normal condition of the battery voltage. In this case, of course, repetition of advancing and stopping of the 1/20th second hand during the first one second surely alerts the user to the degenerating condition of the battery voltage.

Besides, by combining whatever of each output of the second measuring counter 226 and of the minute measuring counter 235, there are various ways to indicate that exhaustion of battery life is approaching. For instance, the 1/20th second hand is driven at 20 Hz for the first one second after starting time measurement and standstill indicating zero, and the hand repeats advancing at 20 Hz and stopping at the position indicating zero every one second for some minutes after starting time measurement and standstill indicating zero thereafter, and so on.

In accordance with this invention, (FIG. 11) as described above, when the battery voltage detector detects a lower voltage than a certain value, that is, when the battery life is about to be exhausted, driving a step motor for driving a hand displaying time in a unit under one second is controlled to alert the user of the stopwatch to the degenerating condition of the battery voltage. Further, the power consumption near the end of the battery life is greatly reduced and the time from the beginning of the battery voltage reduction until exhaustion of the battery life is prolonged. Consequently, the user of the stopwatch has more opportunities to be aware that the termination of battery life is approaching.

In the above described embodiment, the unit under one second is the 1/20th second as an example. However, the conception of this invention can be equivalently applied to the case in which the unit under one second is 1/10th second, 1/50th second, 1/100th second, or the like.

It will thus be seen that the objects set forth above, and those made apparent from the preceding description, are efficiently attained and, since certain changes may be made in the above constructions without departing from the spirit and scope of the invention, it is intended that all matter contained in the bove description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An analog display stopwatch for displaying elapsed time in selected time units by means of at least one hand driven by an electrical step motor, said stopwatch comprising: oscillator means for generating a high frequency signal, divider means for reducing said high frequency standard standard signal to lower frequency timekeeping signals and driver means for driving said motor on command on response to said lower frequency signals for indicating elapsed time in a selected time unit, said driver means including:

switch control circuit means for generating a signal respectively for commanding a start and a stop for time measurement and a signal for commanding a return-to-zero of each hand;

detector means for detecting the elapse of a preselected time period, said time period being measured from initiation of time measurement; and hand driving control circuit means for permitting continuous driving of each hand during time measurement within said time period, driving at least one hand to a zero position upon the elapse of said time period and driving the at least one hand to display the elapsed time upon generation of the stop signal after the time period.

2. The analog display stopwatch of claim 1 wherein the switch control circuit means further generates a signal to display a split time and said hand driving circuit means is further adapted to drive said at least one hand to the zero position in response to one of a command signal from said switch control circuit means after said signal for displaying said split time is released and after a signal commanding a return to zero of said at least one hand is output by said switch control circuit means.

3. The analog display stopwatch of claim 1 wherein the period is ten minutes.

4. The analog display stopwatch of claim 1, wherein the at least one hand returns to the zero-position after ten minutes have elapsed from the beginning of time measurement.

5. The analog display stopwatch of claim 1 wherein there are three hands driven by the electrical step motor.

6. The analog display stopwatch of claim 5 wherein the time units of the three hands are minutes, seconds and fractions of a second.

7. The analog display stopwatch of claim 6 wherein the hand displaying fractions of a second is driven to the zero position upon the elapse of the time period.

8. The analog display stopwatch of claim 6 wherein all the hands of the stopwatch are driven to the zero position upon the elapse of the time period.

9. In an analog display stopwatch for displaying elapsed time in selected time units by means of at least one hand driven by an electrical step motor, said stopwatch including oscillator means for generating a high frequency time standard signal, divider means for reducing said high frequency standard signal to lower frequency timekeeping signals, and driver means for driving said motor on command in response to said lower frequency signals for indicating elapsed time in a selected time unit, the improvement therein comprising:

switch control circuit means for generating a signal respectively for commanding a start and a stop for time measurement, a signal for commanding to display a split time; and a signal for commanding a return-to-zero of said hands;

a detector for detecting elapse of a preselected time period T, said time period T being measured from initiation of time measurement;

hand driving control circuit means for driving said at least one hand continuously during time measurement within said period T, and for driving said at least one hand to the zero-position after completion of said period T, and for retaining said at least one hand at said zero-position during further time measurement in excess of said period T;

means for counting said lower frequency time signal electrically during said time measurement when said at least one hand is retained at said zero-position, said hand driving control circuit means being adapted to drive said at least one hand upon the occurrence of a signal from said switch control circuit means for commanding to display one of a split time and a stop for time measurement, said at least one hand completing a revolution in a prescribed number of steps, said motor driving said at least one hand only for the remainder obtained by dividing the count number in said counting means by said number of steps, said at least one hand advancing and indicating the elapsed time in said selected time unit of said at least one hand upon occurrence of said stop or split signal.

* * * * *